US007736182B2

(12) United States Patent
Pan

(10) Patent No.: US 7,736,182 B2
(45) Date of Patent: Jun. 15, 2010

(54) HIGH SPEED ELECTRICAL CONNECTOR HAVING IMPROVED HOUSING

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,506

(22) Filed: Mar. 25, 2009

(65) Prior Publication Data

US 2009/0247012 A1 Oct. 1, 2009

(30) Foreign Application Priority Data

Mar. 25, 2008 (CN) ..... 2008 2 0033112 U

(51) Int. Cl.
*H01R 13/648* (2006.01)

(52) U.S. Cl. ..... 439/607.07

(58) Field of Classification Search ..... 439/607.05–607.07

See application file for complete search history.

(56) References Cited

U.S. PATENT DOCUMENTS 6,461,202 B2 10/2002 Kline
6,638,110 B1 * 10/2003 Billman ..... 439/607.07
6,743,057 B2 * 6/2004 Davis et al. ..... 439/701
6,875,031 B1 * 4/2005 Korsunsky et al. ..... 439/79
6,979,202 B2 * 12/2005 Benham et al. ..... 439/65
7,195,519 B1 * 3/2007 McAlonis et al. ..... 439/607.39
2004/0018773 A1 * 1/2004 Forman ..... 439/608
2004/0229509 A1 * 11/2004 Consoli et al. ..... 439/608
2006/0189212 A1 * 8/2006 Avery et al. ..... 439/608
2009/0227141 A1 * 9/2009 Pan ..... 439/607.03

* cited by examiner

*Primary Examiner*—Gary F. Paumen
(74) *Attorney, Agent, or Firm*—Ming Chieh Chang; Wei Te Chung

(57) ABSTRACT

An electrical connector (1) includes a housing (10) and a number of wafers (20). Each wafer has a number of contacts (30) each having a contacting portion (31). The housing includes an insulative base (11) having a number of chambers (115) and a number of spacers (13) mounted on the insulative base. Each spacer includes a main portion (131), and a number of finger-shaped portions (132) formed on the main portion. Each finger-shaped portion has a floor (133) and a number of projecting walls (134,135) projecting laterally from the floor to form a plurality of passageways. The finger-shaped portion inserted in the chamber of the insulative base. Each passageway has an open front end (137) and an open rear end (138), the contacting portion of the contact inserted into the passageway from the open rear end toward the open front end.

16 Claims, 5 Drawing Sheets

HIGH SPEED ELECTRICAL CONNECTOR HAVING IMPROVED HOUSING

BACKGROUND OF THE INVENTION

1. Field of the Invention

The present invention relates to a high speed electrical connector, and more particularly, to a high speed electrical connector for transmitting high speed signal between mother boards and daughter boards or other electrical components.

2. Description of Related Arts

High speed electrical connector used in High speed systems typically has a great number of contacts, and an insulative housing having a great number of passageways for receiving the contacts. A high speed electrical connector is disclosed in U.S. Pat. No. 6,461,202 issued to Kline on Oct. 8, 2002. The electrical connector includes an insulative housing, a spacer, and a plurality of wafers having a plurality of contacts insert molded on the wafer. The spacer defines thereon a plurality of passageways each having an open side. The wafer should be assembled to the spacer prior to inserting the spacer together with the wafer into the insulative housing, since the contacts of the wafer are pressed into the passageways via the open side. During the assembly of the spacer and the wafer, the wafer is assembled to the spacer via an engagement between a plurality of holes defined on the wafer and corresponding posts formed on the spacer.

When the engagement between the holes defined on the wafer and corresponding posts formed on the spacer is not reliable, it is hard to insert the wafer and the spacer to the predetermined position. Therefore, the contacts could not be fixed in the predetermined position within the insulative housing firmly.

Hence, an improved electrical connector is needed to solve the above problem.

SUMMARY OF THE INVENTION

An object of the present invention is to provide a high speed electrical connector having an improved housing for firmly fixing a plurality of contacts.

To achieve the above object, an electrical connector includes a housing and a plurality of wafers. Each wafer has a plurality of contacts and each contact having a contacting portion. The housing includes an insulative base having a plurality of chambers and a plurality of spacers mounted on the insulative base. Each spacer includes a main portion, and a plurality of finger-shaped portions formed on the main portion. Each finger-shaped portion has a floor and a plurality of projecting walls projecting laterally from the floor to form a plurality of passageways. The finger-shaped portion inserted in the chamber of the insulative base. Each passageway has an open front end and an open rear end, the contacting portion of the contact inserted into the passageway from the open rear end toward the open front end.

The spacer is conveniently inserted into the insulative base to form the passageways having open front end and open rear end for easing insertion of the contacts along a back-to-front direction. The spacer and the contacts could be respectively firmly fixed in the predetermined position within the housing, via the convenient ordinal insertion of the spacer and the wafer.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
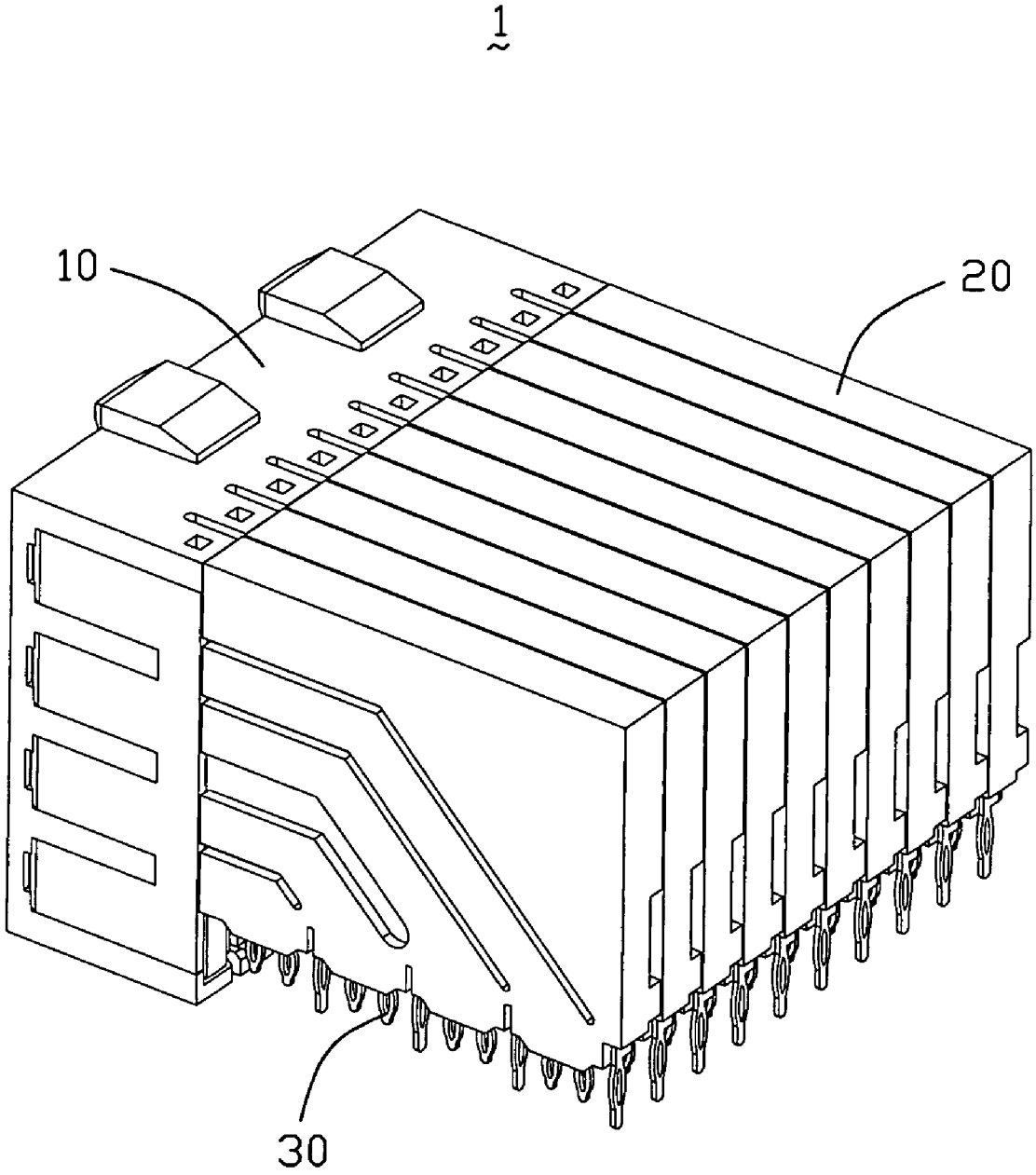
FIG. 1 is an assembled perspective view of an electrical connector of the present invention.

Reference will now be made to the drawing figures to describe the present invention in detail. FIG. 1 illustrates an electrical connector 1 having an insulative housing 10 and a plurality of wafers 20 mounted on the insulative housing 10. Each wafer 20 has a plurality of contacts 30 and shielding plates 40.

Figure 2:
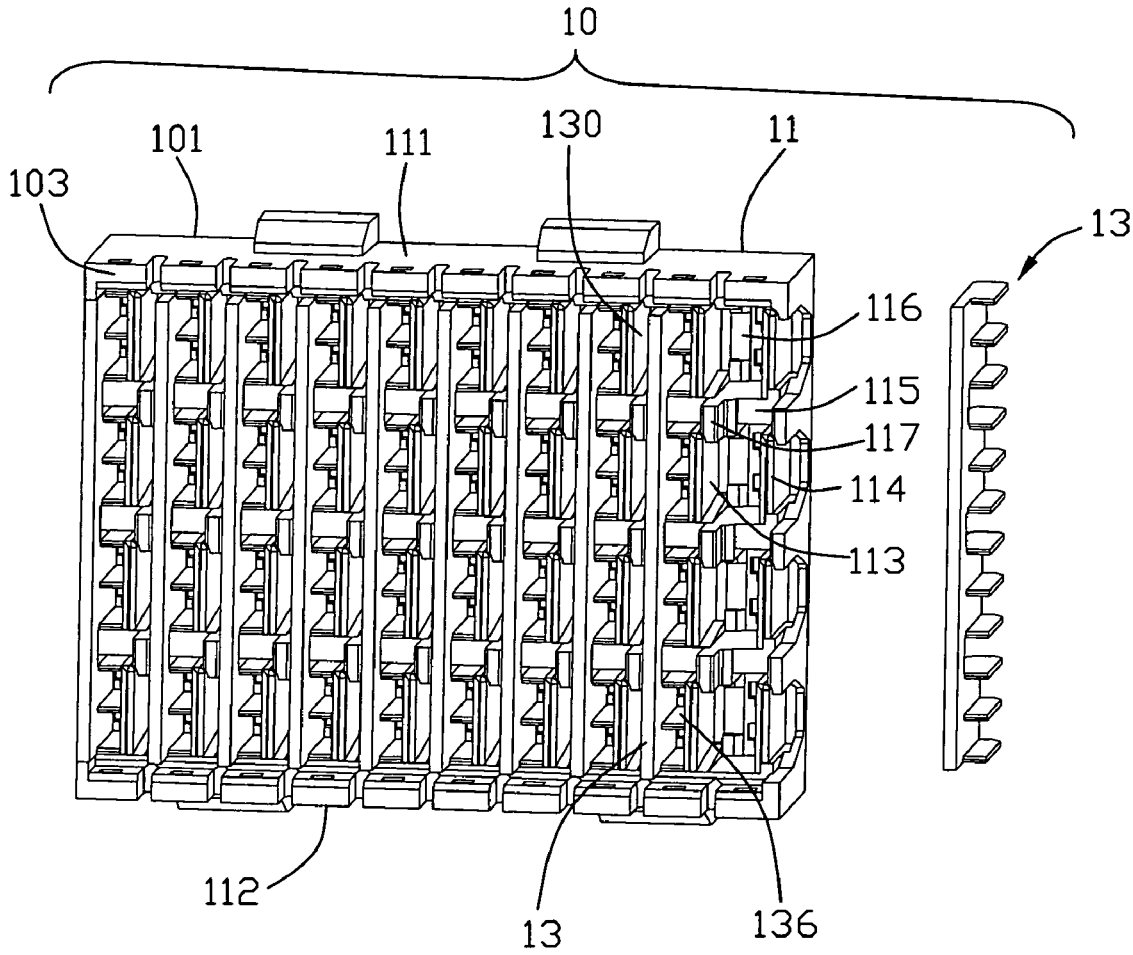
FIG. 2 is a partially exploded perspective view showing a spacer separated from the insulative base of the electrical connector as shown in FIG. 1.

Referring to FIG. 2, the insulative housing 10 has a mating surface 101 and an opposite mounting surface 103. The insulative housing 10 includes an insulative base 11 and a plurality of spacers 13 mounted on the insulative base 11. The insulative base 11 is of a substantially rectangular cube portion and has a top wall 111 and a bottom wall 112. The insulative base 11 includes a plurality of vertical wall pairs each having a first vertical wall 113 and a second vertical wall 114, and a plurality of horizontal walls 115 perpendicular to the vertical wall pairs 113,114. The insulative base 11 has a plurality of chambers 116 defined by the vertical wall pairs 113,114 and the horizontal walls 115. And each chamber 116 is defined between the first vertical wall 113 and the second vertical wall 114. The horizontal walls 115 have a plurality of protruding portions 117 projecting from the mounting surface 103. Each protruding portion 117 is disposed between the first vertical wall 113 and the second vertical wall 114.

Figure 3:
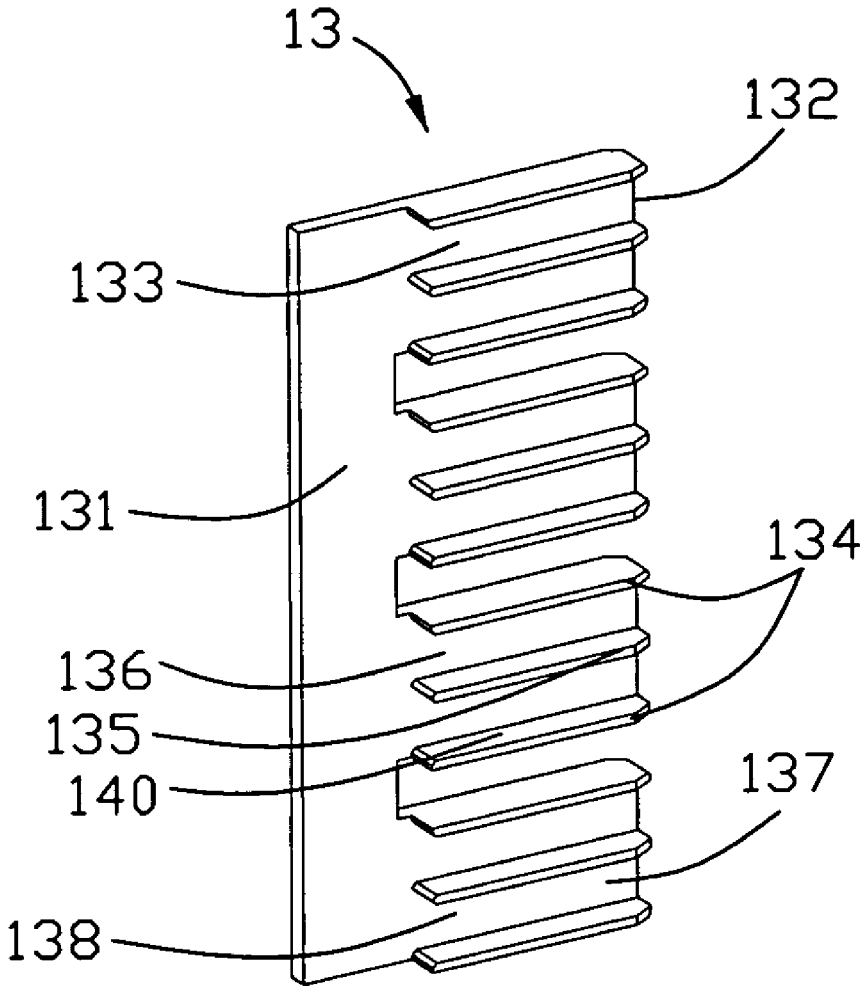
FIG. 3 is a perspective view of a spacer of the electrical connector as shown in FIG. 1.

Referring to FIGS. 2 and 3, a plurality of spacers 13 are mounted on the insulative base 11. Each spacer 13 has a main portion 131 and a plurality of finger-shaped portions 132 formed on the main portion 131. Each finger-shaped portion 132 has a floor 133 and a plurality of projecting walls 134, 135 projecting laterally from the floor 133. The finger-shaped portion 132 received in the chamber 116 of the insulative base 11 to divide the chamber 116 into a plurality of passageways 136 via the floor 133 and the projecting walls 134, 135. Each passageway 136 has an open front end 137 and an open rear end 138. The projecting walls 134, 135 includes a pair of sidewalls 134 and a center wall 135 disposed between the pair of sidewalls 134. Each of the pair of sidewalls 134 and the center wall 135 has an inner surface 140 facing to the contact 30, and the inner surface 140 of the sidewalls 134 and the center wall 135 parallel to each other.

The finger-shaped portion 132 is disposed between the first vertical wall 113 and the second vertical wall 114. The pair of sidewalls 134 and the center wall 135 of the finger-shaped portion 132 resist against the first vertical wall 113. The main portion 131 resists against the protruding portions 117. The floor 133 of finger-shaped portion 132 is separated from the second vertical wall 114 to define a cavity 130 adjacent to the passageways 136.

Figure 4:
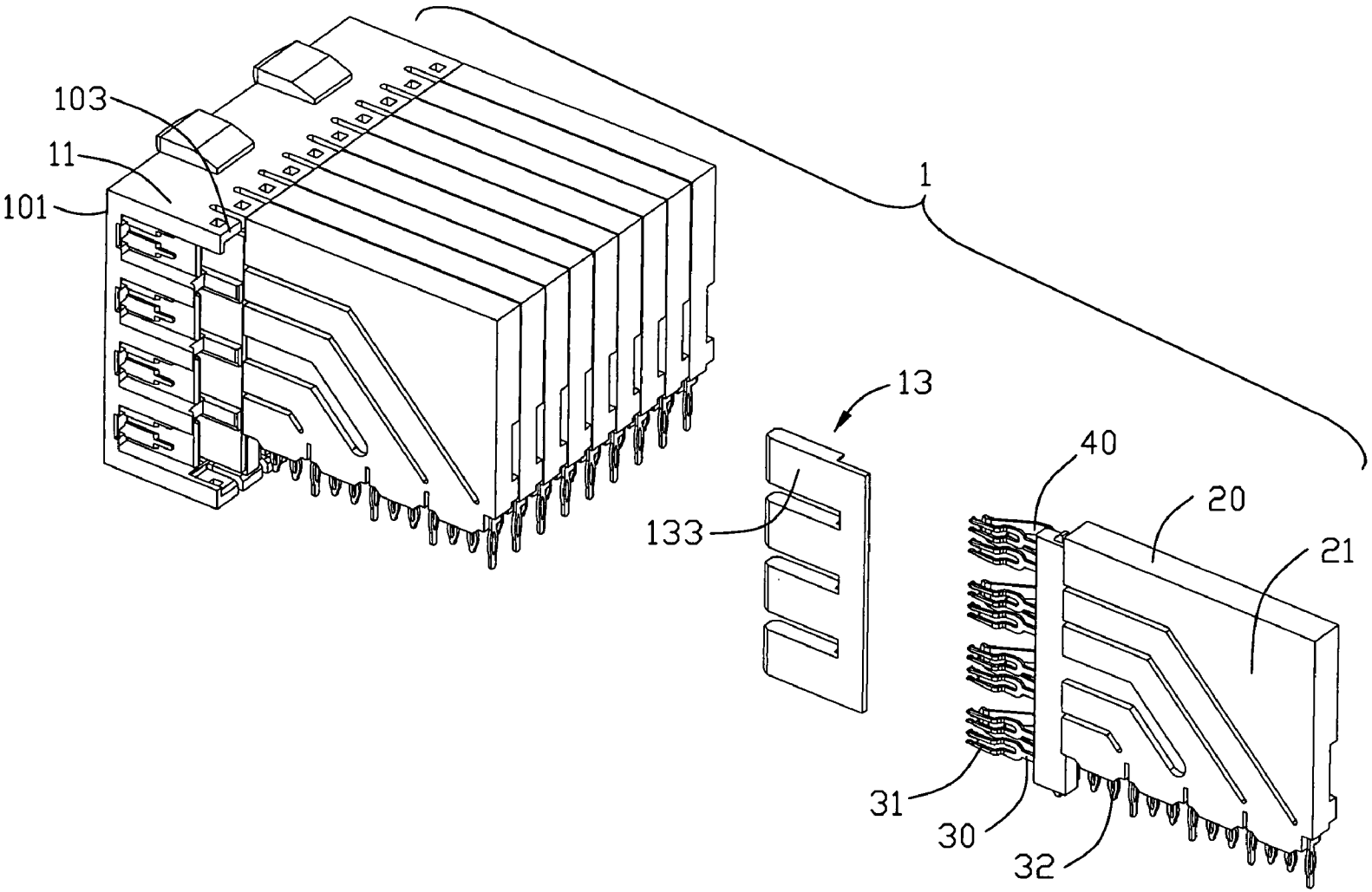
FIG. 4 is a partially exploded perspective view showing a spacer and a wafer separated from the electrical connector as shown in FIG. 1.
Figure 5:
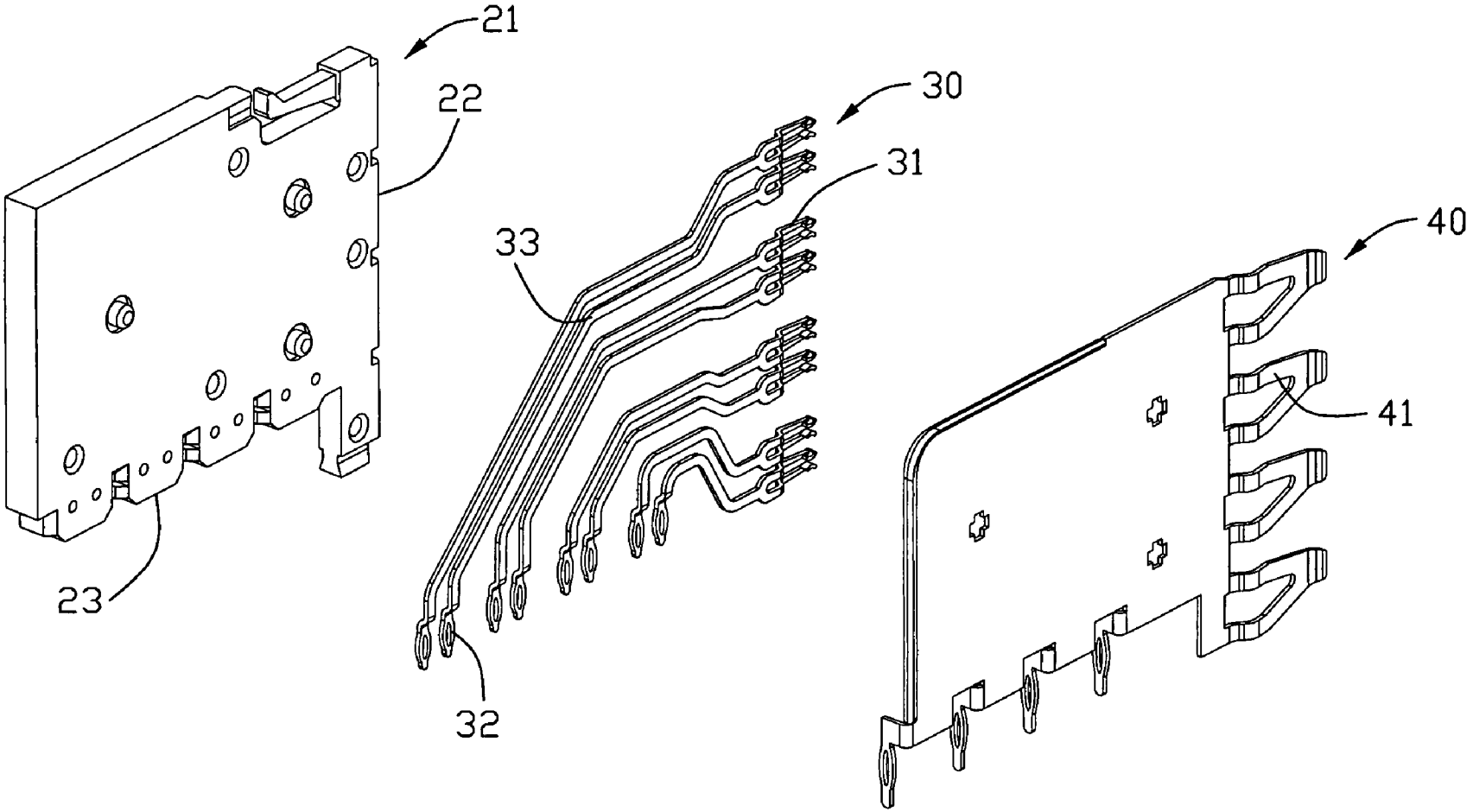
FIG. 5 is an exploded perspective view of a wafer of the electrical connector as shown in FIG. 1.

Referring to FIGS. 4 and 5, a plurality of wafers 20 mounted on the insulative housing 10 in side-by-side arrangement. Each wafer 20 includes an insulative layer 21 having a vertical edge 22 and a horizontal edge 23.

A plurality of contacts 30 are insert molded in the insulative layer 21 and arranged in a pattern of contact pairs. Each contact 30 has a contacting portion 31 having a pair of connecting beams for electrically connecting with a header pin (not shown) of a mating electrical connector (not shown). The contacting portion 31 is disposed on the vertical edge 22 of the insulative layer 21 for inserting into the passageway 136 of the housing 10. The contact 30 has a tail portion 32 located at horizontal edge 23 of the insulative layer 21, and an interconnected portion 33 interconnected with the tail portion 32 and the contacting portion 31. The interconnected portion 33 is insert-molded in the insulative layer 21.

A shielding plate 40 is attached to a lateral surface of the insulative layer 21. The shielding plate 40 has a plurality of V-shaped mating portions 41 disposed on the vertical edge 22. The mating portions 41 insert into the cavity 130 along a back-to front direction for electrically connected with a shielding plate (not shown) of the mating electrical connector.

In molding the insulative base 11, plastic material is injected into a first mold (not shown) from injecting inlets (not shown). Because the chambers 116 of the insulatice base 11 have sufficient space, the vertical wall pairs 113, 114 and the horizontal walls 115 are completely formed at the same time. In addition, in molding the spacers 13, plastic material is injected into a second mold (not shown) from injecting inlets (not shown). The sidewalls 134 and the center walls 135 of the spacers 13 are completely formed at the same time. During assembly, firstly, the spacers 13 are mounted to the insulative base 11. The finger-shaped portions 132 of the spacers 13 are inserted in the chambers 116 of the insulative base 11 to divide the chambers 116 into a plurality of passageways 136 and cavities 130. Then the wafers 20 are mounted to the housing 10. The contacting portions 31 of the contacts 30 insert into the passageways 136, and the V-shaped mating portions 41 of the shielding plate 40 insert into the cavities 130. The spacers 13 are conveniently mounted to the housing to form the passageways 136 having open front end 137 and open rear end 138 for easing insertion of the contacts 30 along a back-to-front direction. The spacers 13 and the contacts 30 could be respectively firmly fixed in the predetermined position within the housing 10, via the convenient ordinal insertion of the spacers 13 and the wafers 20.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector comprising:

a plurality of wafers each having a plurality of contacts, each contact having a contacting portion; and a housing comprising:

an insulative base having a mating surface, a mounting surface opposite to the mating surface, and a plurality of chambers extending through the mating and the mounting surfaces; and a plurality of spacers mounted on the insulative base, each spacer comprising a plurality of finger-shaped portions each of which comprises a floor and a plurality of projecting walls projecting laterally from the floor to form a plurality of passageways, each finger-shaped portion being inserted in the chamber of the insulative base from the mounting surface to the mating surface, each passageway having an open front end and an open rear end so that the passageway extends through the spacer along a rear-to-front direction, the contacting portions of the contacts being inserted into the passageways from the open rear end toward the open front end along the rear-to-front direction; wherein the spacers are assembled to the base prior to assembling of the wafers to the base, and the wafers are assembled to the base behind the spacers for preventing backward withdrawal of the spacers from the base.

2. The electrical connector as claimed in claim 1, wherein each projecting wall has an inner surface facing to the contacting portion, and the inner surfaces of the projecting walls are parallel to each other.

3. The electrical connector as claimed in claim 1, wherein said projecting walls disposed on each finger-shaped portion comprise a pair of sidewalls and a center wall disposed between the pair of sidewalls, the passageways being formed by one of the side walls and the center wall, and being formed by the other of the side walls and the center wall.

4. The electrical connector as claimed in claim 1, wherein said insulative base has a plurality of vertical wall pairs, each vertical wall pair comprises a first vertical wall and a second vertical wall, and each chamber is defined between the first vertical wall and the second vertical wall of the vertical wall pair.

5. The electrical connector as claimed in claim 4, wherein each finger-shaped portion of the spacers is disposed between the first vertical wall and the second vertical wall, the projecting walls of the finger-shaped portion resisting against the first wall, the floor of the finger-shaped portion separated from the second vertical wall to define a cavity adjacent to the passageways.

6. The electrical connector as claimed in claim 5, wherein each wafer comprises an insulative layer and a shielding plate attached to a lateral surface of the insulative layer, the shielding plate having a plurality of mating portions received in the cavities.

7. The electrical connector as claimed in claim 6, wherein each contact has a tail portion and an interconnected portion connected with the contacting portion and the tail portion, the interconnected portion insert molded in the insulative layer.

8. The electrical connector as claimed in claim 5, wherein the insulative base comprises a plurality of horizontal walls perpendicular to the vertical walls, the horizontal walls having a plurality of protruding portions, the spacers each comprising a main portion extending from the finger-shaped portions to resist against the protruding portions.

9. An electrical connector comprising:

a plurality of wafers each having a plurality of contacts with contacting portions thereof in a front portion;

an insulative housing defining a plurality of chambers each extending in a lengthwise direction;

a plurality of partitions formed in each of said chambers, each of said partitions extending in a transverse direction perpendicular to said lengthwise direction;

a plurality of spacers received in the corresponding chambers, respectively, each of said spacers defining a plurality of passageways extending along a front-to-back direction perpendicular to both said lengthwise direction and said transverse direction to receive the corresponding contacting sections, and further a plurality of recesses to receive the corresponding partitions, respectively, for retaining the spacer in the corresponding chamber.

10. The electrical connector as claimed in claim 9, wherein said spacer defines a main plate under condition that the passageway is shielded by the main plate in the transverse direction while the recess extends through the main plate in said transverse direction.

11. The electrical connector as claimed in claim 9, wherein said contacts are insert molded in an insulator of the wafer.

12. The electrical connector as claimed in claim 9, wherein each spacer is forwardly assembled into the corresponding chamber from a rear face of the corresponding chamber, and the corresponding wafer is assembled to the rear face of the corresponding chamber after the corresponding spacer is forwardly assembled into the corresponding chamber under condition that the corresponding wafer is located behind the corresponding spacer for preventing rearward withdrawal of the corresponding spacer from the corresponding chamber.

13. An electrical connector comprising:

a plurality of wafers each comprising an insulative layer, a plurality of contacts embedded in the insulative layer and a shielding plate laterally attached to the insulative layer, each contact having a flexible contacting portion extending beyond the insulative layer along a rear-to-front direction; and a housing for receiving the wafers, the housing comprising:

an insulative base defining a plurality of chambers each of which is formed by a first vertical wall and a second vertical wall; and a plurality of spacers received in the chambers in order to divide the chambers into first and second passageways, each spacer comprising a vertical floor located between the first and the second vertical walls under a condition that the first passageway is formed by the first vertical wall and the vertical floor, and the second passageway is formed between the second vertical wall and the vertical floor; the first and the second passageways extending through the spacers along the rear-to-front direction in order to receive the flexible contacting portions of the contacts and engaging portions of the shielding plates, respectively; wherein the spacers are unconnected with the insulative layers of the wafers.

14. The electrical connector as claimed in claim 13, wherein the spacers are assembled to the housing prior to assembling of the wafers.

15. The electrical connector as claimed in claim 13, wherein each spacer comprises a plurality of projecting walls laterally extending from the vertical floor, the first passageways being formed by the projecting walls.

16. The electrical connector as claimed in claim 15, wherein the projecting walls abut against the first vertical wall.

* * * * *